United States Patent [19]

St. Charles

[11] Patent Number: 4,934,524

[45] Date of Patent: Jun. 19, 1990

[54] PACKAGE FOR STORING MOISTURE LADEN ARTICLES

[75] Inventor: Frank K. St. Charles, Fisherville, Ky.

[73] Assignee: Brown & Williamson Tobacco Corporation, Louisville, Ky.

[21] Appl. No.: 245,609

[22] Filed: Sep. 19, 1988

[51] Int. Cl.[5] ..... B65D 81/26; B65D 85/10

[52] U.S. Cl. ..... 206/204; 206/242; 206/205

[58] Field of Search ..... 206/205, 242, 204

[56] References Cited

U.S. PATENT DOCUMENTS

| | | | |
|---|---|---|---|
| 290,140 | 12/1983 | Swift | 206/205 |
| 1,205,751 | 11/1916 | King | 206/205 |
| 2,270,603 | 1/1942 | Ridder | 206/205 |
| 2,329,908 | 9/1943 | Johnson | 206/205 |
| 2,333,270 | 11/1943 | Opler | 206/205 |
| 3,809,223 | 5/1974 | Kendall | 206/204 |
| 4,674,630 | 6/1987 | Kirck | 206/205 |

FOREIGN PATENT DOCUMENTS

| | | | |
|---|---|---|---|
| 0478793 | 11/1938 | United Kingdom | 206/204 |
| 1369992 | 10/1974 | United Kingdom . | |

*Primary Examiner*—Paul T. Sewell
*Assistant Examiner*—Jacob K. Ackun, Jr.
*Attorney, Agent, or Firm*—Charles G. Lamb

[57] ABSTRACT

A storage package for storing moisture-laden articles such as cigarettes including a shaped receptacle sized to receive a plurality of cigarettes, the receptacle having a moisture control vehicle disposed therein within an overwrap having a low moisture vapor transmission rate (MVTR) with such vehicle being treated with a saturated salt solution having a water activity level preselected to the water activity level of the cigarettes to maintain moisture equilibrium over an extended time period.

27 Claims, 3 Drawing Sheets

PACKAGE FOR STORING MOISTURE LADEN ARTICLES

BACKGROUND OF THE INVENTION present invention relates to storage package structure particularly to a package for storing moisture-laden articles to maintain a proper moisture content in the stored articles over an extended period of time such as in the packaging of cigarettes.

It is known in the art of packaging perishable goods of various types such as foods, electronic equipment and tobaccos to keep them either from drying out or absorbing too much moisture by utilizing substantially sealed packages. Such packaging is comparatively expensive, particularly with respect to low cost perishable articles having a short life from the time of packaging to the time of consumption.

A number of packaging structures in the tobacco art have been utilized besides sealing to maintain moisture levels in the package. A number of patents are known in the tobacco art wherein moisturized vehicles in the form of absorbent pads, such as sponges or paper, are included in a package to maintain the humidity of the tobacco. In this regard, attention is directed to U.S. Pat. Nos. 1,205,751, issued to J. J. King on Nov. 21, 1916; No. 1,249,490, issued to J. F. Prather on Dec. 11, 1917; No. 1,711,971, issued to J. W. Schulze on May 7, 1929; No. 1,954,577, issued to T. P. Reddin on Apr. 10, 1934; No. 1,967,554, issued to P. M. Gross et al on July 24, 1934; No. 1,972,118, issued to R. D. McDill on Sept. 4, 1934; No. 1,972,222, issued to P. M. Gross et al on Sept. 4, 1934; No. 1,998,683, issued to F. H. Montgomery on Apr. 23, 1935; No. 2,227,158, issued to W. H. Saul on Dec. 31, 1940; No. 2,270,603, issued to B. H. Ridder on Jan. 20, 1942; No. 2,276,217, issued to D. P. Lee on Mar. 10, 1942; No. 2,329,908, issued to C. E. Johnson on Sept. 21, 1943; No. 2,333,270, issued to A. M. Opler on Nov. 2, 1943; No. 2,368,140, issued to C. E. Johnson on Jan. 30, 1945; No. 2,443,139, issued to F. A. Krause on June 8, 1948; No. 2,452,957, issued to A. R. Sabin on Nov. 2, 1948; No. 2,497,627, issued to J. E. Pollack on Feb. 14, 1950; No. 2,505,650, issued to P. W. Rodman on Apr. 25, 1950; No. 2,522,952, issued to J. Krohn on Sept. 15, 1950; No. 2,559,297, issued to J. J. Hasbrook et al on July 3, 1951; No. 2,635,937, issued to H. J. Erb, Jr. on Apr. 21, 1953; No. 2,807,514, issued to D. J. Williams on Sept. 24, 1957, No. 2,862,779, issued to C. 0. Hammond on Dec. 2, 1958; No. 3,135,565, issued to R. Bingham on June 2, 1964, and No. 3,336,093 issued to J. J. Phelps on Aug. 15, 1967. Among these several aforenoted patents U.S. Pat. Nos. 2,270,603 and No. 2,452,957, teach the use of a Glauber salt as a humidifying agent and aforenoted U.S. Pat. Nos. 2,329,908 and No. 2,368,140 teach the use of an outer layer of moisture impervious material in conjunction with the moisturized vehicles employed in the packages. However, neither in the above noted patents nor in any other known prior art is the unique packaging structure of the present invention taught or suggested, the present invention recognizing the desirability of maintaining a preselected relative humidity or water activity within the packaging structure over an extended period of time. Equally, the present invention recognizes the importance of accomplishing this balancing of humidification without cigarette spotting, microbial growth or other damage to the packaged article and, at the same time, avoids imparting undesirable and deleterious tastes and odors to the stored tobacco articles.

In accordance with the present invention, a straightforward, comparatively inexpensive to manufacture and assemble packaging structure for tobacco articles is provided which contemplates and provides not only balanced humidification over comparatively extended periods of time but does so without requiring large volumes in packaging and without changing moisture conditions within the package structure for the comparatively extended time periods. Further, the present invention permits the use of various types of space saving moisturizing vehicles in novel geometric configurations without sacrifice of other desirable features of the invention and without deleterious effects to the packaged articles.

Various other features of the present invention will become apparent to one skilled in the art upon reading the disclosure set forth herein.

SUMMARY OF THE INVENTION

More particularly the present invention provides a unique and novel packaging structure for storing moisture-laden articles comprising: an overwrap layer having a low moisture vapor transmission rate (MVTR); a shaped receptacle cooperatively disposed with respect to the overwrap layer and preselectively sized and shaped to receive the moisture-laden articles for storing such articles; and, a moisture control vehicle disposed within the overwrap layer of the package, the vehicle being treated with a saturated salt solution having a water activity level preselected in accordance with the water activity level of the moisture-laden articles stored in the package to maintain a controlled moisture equilibrium in the stored moisture-laden articles over an extended period of time. The present invention further provides several variations of salt solutions, moisture control vehicles and geometric configurations thereof, as well as variations of outer wrappers and packaging receptacles - all of which are particularly suited for the moisture control of tobacco articles such as cigarettes. Further, the present invention provides an inner wrapper surrounding the moisture-laden articles when packaged within the shaped receptacle.

It is to be understood that various changes can be made by one skilled in the art in one or more of the several parts of the packaging structure disclosed herein without departing from the scope or spirit of the present invention.

BRIEF DESCRIPTION OF THE DRAWINGS

Referring to the several figures of the drawings which disclose an advantageous embodiment of the present invention and several modifications thereto.

DETAILED DESCRIPTION OF THE INVENTION

Figure 1:
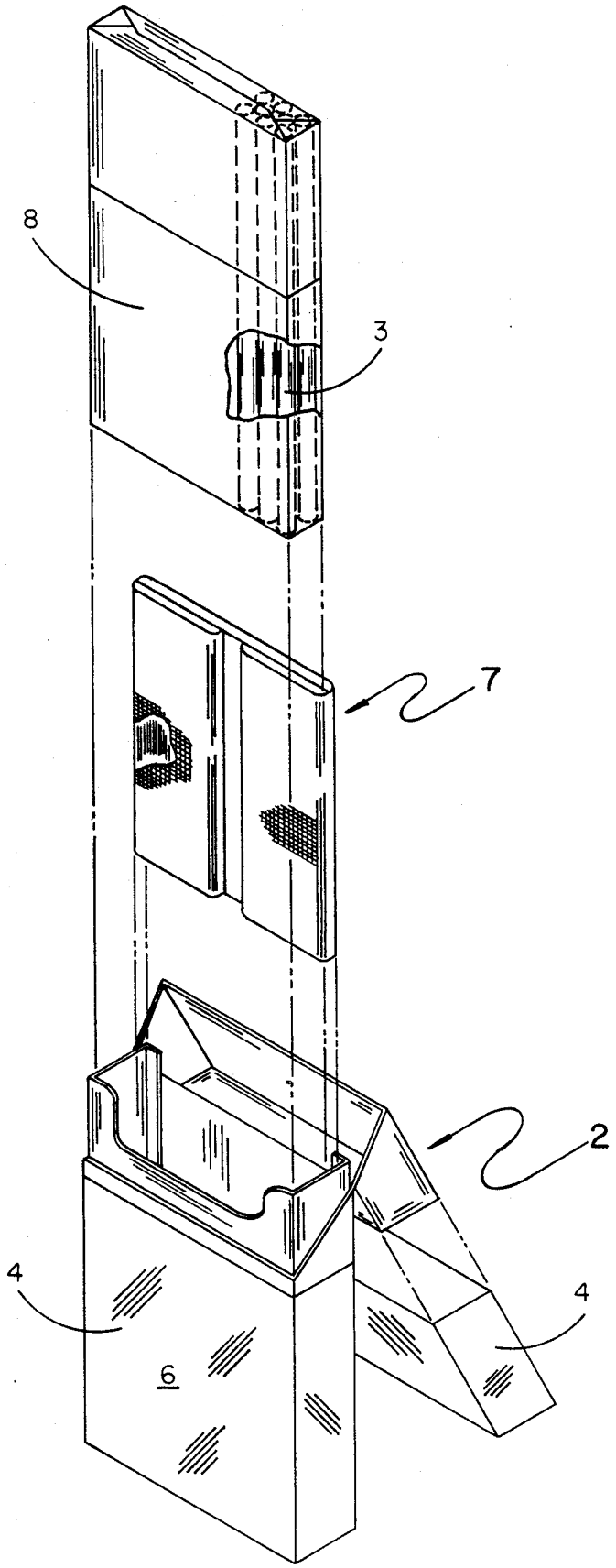
FIG. 1 is an exploded isometric view of the inventive packaging structure in the form of a package of cigarettes.

As above discussed, packaged articles become unacceptable when they dry out and it is generally known to use a humidifying agent with the packaged articles in an attempt to maintain a preselected relative humidity within the package. As also is above discussed, it is generally known to utilize packaging overwrap material with reduced moisture permeability and to improve overwrap sealing to extend the shelf life of packaged articles. In the more recent packaging of tobacco articles such as cigarettes, cigarette manufacturers have concentrated on the latter approach, namely reducing overwrap moisture permeability and improving overwrap sealing.

The present invention recognizes the importance of maintaining a preselected water activity within a package to reduce packaged article moisture loss rate even though moisture loss rate from the package is unchanged. Water activity in air can be defined as the relative humidity (RH) divided by 100 and, in a package, at equilibrium, the water activity for all components within the package is equal. The basic concept of humidification within a package is to provide a reservoir of water within the package to reduce packaged article moisture loss over an extended time period. The present invention recognizes that providing a reservoir of pure water with a packaged article is not satisfactory since too much water may transfer to the article, creating problems in moisture spotting and microbial growth.

To meet this problem the present invention, instead of utilizing just water, as has been past practice, provides an inventively preselected saturated solution so selected that if water passes from the saturated solution to the packaged article, the concentration of water in the saturated solution does not change but rather crystals fall out of the solution and the water activity within the package or the inventively balanced equilibrium does not change until all the water from the solution is exhausted. Only on this occasion—after a time period which has been comparatively extended—will the packaged article lose moisture and dry.

It is recognized by the present invention that ideally tobacco is best conditioned to have an approximate relative humidity of 60% (RH) or, in other words, a water activity of 0.6. Accordingly, when a plurality of cigarettes with such an ideal humidity are placed in a package having a relative humidity of less than 60%, water is soon lost from the package.

Recognizing that saturated solutions are the desideratum to extended life humidification control for packaged moisture-laden articles, the present invention also further recognizes the importance of selecting saturated solutions of certain salts which not only maintain the desired extended moisture equilibrium in the packages containing the moisture-laden articles but which preselected saturated salt solutions, at the same time, do not create deleterious and adverse effects on the packaged articles. In this regard, the present invention provides saturated solutions of salts which have water activity properties which proximate the ideal water activity of tobacco products such as cigarettes without adversely affecting odor, color or taste of the cigarettes. In addition the present invention provides novel packaging structure which attains desired humidification equilibrium in the package over a comparatively extended period of time.

In carrying out the basic inventive concept to place an additional reservoir of water inside a cigarette package to reduce the rate of moisture loss over an extended time period independent of overwrap permeability and package seals, feasibility tests have been conducted using packaging such as disclosed in FIG. 1 of the drawings.

In this FIG. 1, there is disclosed in exploded view a package structure 2 for storing moisture-laden articles in the form of a plurality of cigarettes 3. The package design was chosen for feasibility tests because it includes an overwrap layer 4 having a very low moisture vapor transmission rate (MVTR) and because it readily provides space for insertion of a selected moisture control vehicle in place of or inclusive of the existing spacer within the package. In this regard and in accordance with the present invention, a sealed overwrap film of flexible transparent polypropylene material can be used. But, in accordance with the present invention, other overwrap materials with low moisture vapor transmission rates (MVTR) such as cellophane, polyethylene and polyvinylidene chloride have been found satisfactory, it being important that the overwrap not only have an acceptable visual appearance and touch response but that it have the required low moisture vapor transmission (MVTR) to insure the extension of moisture equilibrium life within the package. The receptacle 6 can be made from a common paperboard stock of stiffened cartonboard or can be formed from any other suitable material such as, but not limited to, foldable paper material used with other types of cigarette packages, the receptacle being preselectively sized and shaped to receive and store a preselected number of moisture-laden cigarettes 3 with a preselected volume of space remaining in the receptacle 6 between the cigarettes and a side wall of the receptacle. It is to be understood that although overwrap layer 4, as in the package, is located externally of receptacle 6, it also would be possible to locate the overwrap layer 4 on the inside face of receptacle 6 so long as it is cooperatively disposed with respect to the receptacle 6 and surrounds moisture control vehicle 7, described hereinafter. With continued reference to FIG. 1, the moisture control vehicle 7 is sized and shaped to fit within and fill the space between the articles and the side wall of receptacle.

To protect cigarettes 3 from spotting or discoloring through the proximity of moisture control vehicle 7, cigarettes 3 are surrounded by an inner wrapper 8 which, like in the present package, can be an aluminum foil paper laminate. It is to be understood, of course, that the present invention is not limited to an inner wrapper made of such material but that other types of wrappers can be employed which ideally are compatible with the types of moisture control vehicles employed.

Figure 2:
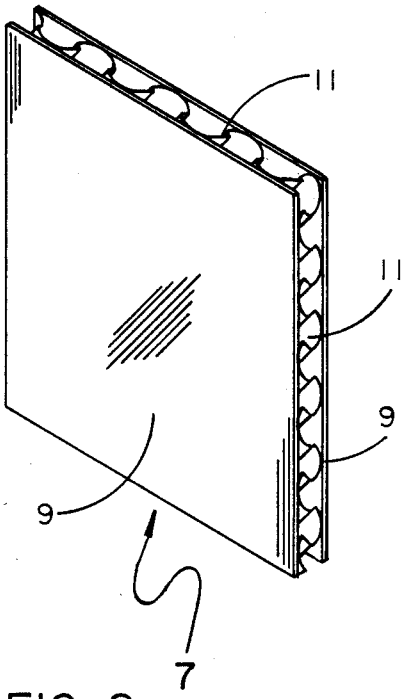
FIG. 2 is an enlarged isometric view of one embodiment of a moisture control vehicle which can be included in the package of FIG. 1, disclosing a flat paper layer with corrugations therebetween which can be treated with an inventive saturated salt solution which can be in one or more of several forms such as a liquid, gel, paste or powder form, or combination thereof.

Although some packages include a corrugated spacer positioned within a cartonboard receptacle 6 between the inner face of receptacle 6 and an inner wrapper 8, which spacers, in accordance 0 with the present invention, can be impregnated over or between corrugations with an appropriate preselected saturated salt solution (described hereinafter) in the form of a liquid, gel, paste or powder or combination thereof, it is to be understood that other types of moisture control vehicles can be employed. For example, standard blotter paper 9 (FIG. 2) which can be corrugated—either lined or unlined—and which can be glued to uncorrugated paperboard 11, can be used as can uncorrugated blotter paper which is glued to corrugated paperboard with the humidifying agent inserted between the corrugations as a gel, paste or powder. Further, normal cellulose acetate filter rods (not shown) treated with an appropriate humidifying agent can be employed as a moisture control vehicle 7.

Figure 3:
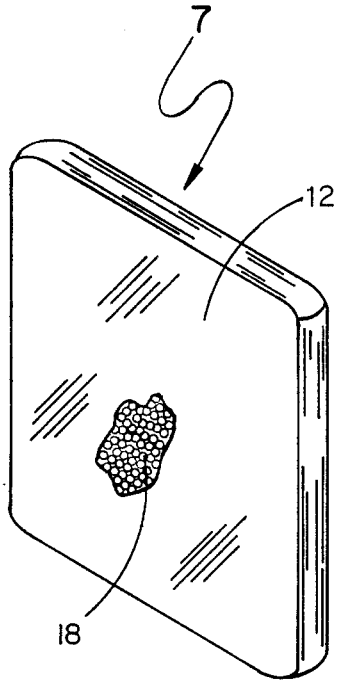
FIG. 3 is an enlarged isometric view of another embodiment of a moisture control vehicle which can be included in a package, disclosing a container bag with a high moisture vapor transmission rate (MVTR) containing an inventive saturated salt solution which can be, as above, in one or more of several forms such as a liquid, gel, paste or powder form or a combination thereof; 1

As can be seen in FIG. 3 of the drawings, the moisture control vehicle can be in the form of a pouch or bag 12 made of cellulose acetate film or in the form of dialysis tubing (not shown), both of which have a very high moisture vapor transmission rate (MVTR) when compared to overwrap layer 4. The pouches, like the structure of FIG. 2 can be filled with the humidifying agent 18 in gel, paste, liquid or powder form to allow water vapor to pass readily therethrough but not liquid. In addition, pouches made of other materials with a high MVTR can be employed. The pouches can be of waterproof, woven or nonwoven fabrics with fine pore structure to restrain liquid but capable of allowing water vapor to pass therethrough. Moreover, it has been recognized and identified that some polymer materials such as nylons and ethylene vinyl acetate copolymers also have suitable properties for use as moisture control pouch vehicles. In fact, small semi-rigid containers of appropriate geometric configuration and porosity could work as well as pouches.

Figure 4:
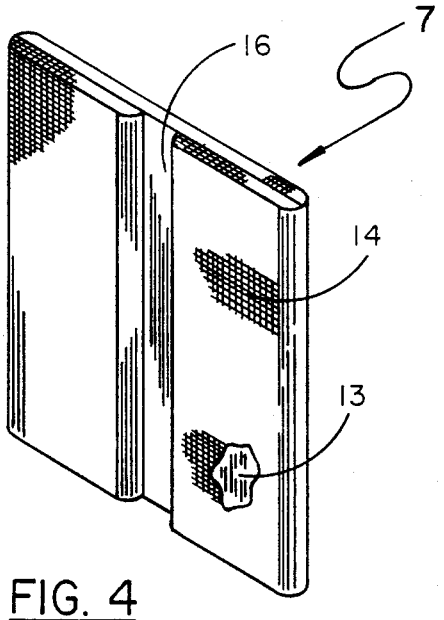
FIG. 4 is an enlarged isometric view of still another moisture control vehicle which can be included in the package of FIG. 1, disclosing details of an advantageous form of such vehicle in a unique folded pad form which has been treated with an inventive saturated salt solution.

Referring to FIG. 4 of the drawings, an absorbent pad 13 folded upon itself is disclosed as an advantageous embodiment of a moisture control vehicle for use in receptacle 6. Absorbent pad 13, which can be formed from a suitable woven or nonwoven fabric material, advantageously is faced on one side thereof with a suitable face layer 14 of material such as a flexible polypropylene. The absorbent pad material which is impregnated with a humidifying agent is one-half as thick as a flat pad to permit folding upon itself at opposite edges thereof away from the facing layer 14 to leave a gap 16 between facing edges of the folded pad with face layer 14 protecting the sides and one face of the folded moisture control vehicle from directly abutting the inner walls of the receptacle so as to prevent any undesirable spotting or staining of the receptacle.

In accordance with the present invention, a number of saturated salt solutions have been identified as having a water activity or relative humidity within a range compatible to the desired relative humidity range for cigarettes, ideally this being approximately 62% RH or 0.62 water activity at 25° C. Among these identified saturated salt solutions, there can be included saturated salt solutions having water activity (or relative humidity) in the range of approximately point five two (0.52) to point six six (0.66). And, advantageously among these saturated salt solutions are included saturated salt solutions of sodium bromide (NaBr) and potassium citrate [$K_3(C_6H_5O_7)$] (tests of which are described below). In this regard, it is to be noted that the saturated salt solution of sodium bromide (NaBr) is included in the below Table I which describes the chemical composition of saturated salt solutions suitable for use in the inventive package structure, Table I setting forth the percent relative humidity of each such saturated salt solution at an indicated temperature (°C) and further indicating by reference number the particular reference literature from which each of such saturated salt solutions was selected. A matching description of these literary references is set forth below Table I. It is to be understood that the solutions can be made from salts in hydrous or anhydrous form.

TABLE I

Relative Humidity of Selected Saturated Salt Solutions

| SALT | RH (%) | TEMP (C) | REF. |
|---|---|---|---|
| $Mg(NO_3)_2$ | 52.89 | 25.0 | 5 |
| $Mg(NO_3)_2$ | 52.90 | 25.0 | 3 |
| $Mg(NO_3)_2$ | 52.91 | 25.0 | 1 |
| $Mg(NO_3)_2$ | 54.38 | 20.0 | 5 |
| NaBr | 56.80 | 26.6 | 2 |
| NaBr | 57.57 | 25.0 | 5 |
| NaBr | 57.70 | 25.0 | 3 |
| NaBr | 58.10 | 21.7 | 2 |
| NaBr | 59.14 | 20.0 | 5 |
| $NH_4NO_3$ | 61.80 | 25.0 | 3 |
| $CoCl_2$ | 64.92 | 25.0 | 5 |
| $Mg(C_2H_3O_2)_2$ | 65.00 | 20.0 | 4 |
| $NaNO_2$ | 66.00 | 20.0 | 4 |

REFERENCES

1. D. T. Acheson, "Vapor Pressures of Saturated Aqueous Salt Solutions" in A. Wexler and W. A. Wildhack, Eds., "Humidity and Moisture" Vol. 3 Fundamentals and Standards, Reinhold Pub. Co., New York, 1965, p521.
2. C. P. Hedlin and F. N. Trofimenkoff, "Relative Humidities over Saturated Solutions of Nine Salts in the Temperature Range from 0 to 90 F.", ibid p519.
3. R. G. Wylie, "The Properties of Water-Salt Systems in Relation to Humidity," ibid p507.
4. "Handbook of Chemistry and Physics," 61st edition, The Chemical Rubber Co., Cleveland, (1980) p. E-46.
5. Lewis Greenspan, "Humidity Fixed Points of Binary Saturated Aqueous Solutions, "J. Res. Natl. Bur. Stand. (U.S.), 81A, No. 1, 89-96 (Jan.-Feb. 1977) and References therein.

Set forth in summary form are experimental results involving recent tests and examinations of saturated potassium citrate solutions and previous tests and examinations of saturated sodium bromide solutions used in combination with moisture control vehicles in the inventive package structure.

As above discussed, the basic concept of the inventive humidor package is to place a solution inside a package of cigarettes which will maintain the relative humidity (RH) at about 60% or water activity of 0.60. This reduces the cigarette moisture loss rate even though the rate of moisture loss from the package is unchanged. Depending on the solution used, the moisture lost from the package will come fully or in part from the added solution until the water in the added solution is used up.

SATURATED POTASSIUM CITRATE SOLUTION

The relative humidity maintained by many humectant and saturated salt solutions is listed in the literature.

In accordance with the present invention, it has been found that saturated potassium citrate solution maintains relative humidity at 62.5% or water activity at 0.625 at 75° F. This is ideal for cigarettes.

The effect of temperature on the relative humidity maintained by saturated potassium citrate solutions was measured and reported. This was done because the relative humidity maintained by some solutions drops to such an extent as temperature is increased, that the solution itself could dry out the cigarettes. For saturated potassium citrate solutions, the humidity maintained by the solution goes from 63.3% RH at 20° C. to 59.6% RH at 40° C. This relative humidity range is ideal for cigarettes.

AGING TESTS

Accelerated aging tests were conducted to test the feasibility of the inventive concept. The aging was accelerated by placing the packages in an environment controlled to 100° F. and 20% relative humidity. These conditions are generally used to simulate arid desert environments where packaged materials tend to lose moisture rapidly.

Results from an accelerated aging test using a saturated NaBr solution on an inert substrate indicate that the shelf life, which is the length of time that cigarettes remain above 12% moisture, of cigarettes was doubled with the humidor package compared to a package without the solution (the control).

The test showed that the concept behaved basically as predicted. Shelf life was doubled for packages which contained 0.5 cc of a saturated NaBr solution, compared to packages without the solution. Specifically, cigarette packages were opened and conditioned over a saturated sodium bromide solution at 24° C.

Saturated NaBr solution (0.5 cc) was added to 25 mm sections of unplasticized cellulose acetate filter rods (24.6 mm circ.). The mean weight of solution added was 0.774 g with a standard deviation of 0.007 g. The filter sections were stored over saturated NaBr in a closed container such as a dessicator until used.

In a conditioned area (75° F., 60% RH), one filter tip per package was placed on top of the internal package spacer in approximately half the packages. These packages were marked with an X. The rest of the packages served as controls.

All packages were then put in a doubled plastic bag until wrapping, by machine, with a suitable polypropylene film commonly used for wrapping cigarette packages. The packages were touched up with a sealing iron to insure good package seals.

Twenty-one packages each of the test and control were randomly mixed, then placed on edge in an environmental cabinet (100° F., 20% RH) with a gap between the packages. Five packages each of the remaining test and control packages were then submitted for oven moisture. Package seals were tested on six packages and all were satisfactory. All blew off of the package seal tester (ARJAY Equipment Corporation, U.S. Pat. No. 4,539,836) with average readings at blowoff of 153 to 174. If held on by hand, readings went over 200. Package seals were also tested at days 18, 21, and 25. All package seals came back at 101 (the upper limit for the computer printout of this test).

Figure 5:
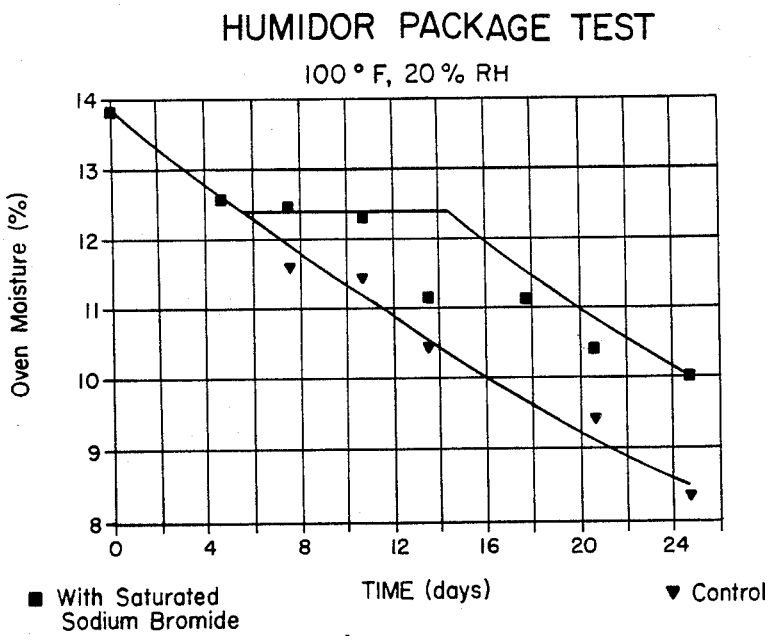
FIG. 5 is a graph representing the results of an earlier test of a moisture control vehicle treated with a saturated salt solution of sodium bromide (NaBr) compared with an untreated vehicle, disclosing the improved moisture control results over an extended time period.
Figure 6:
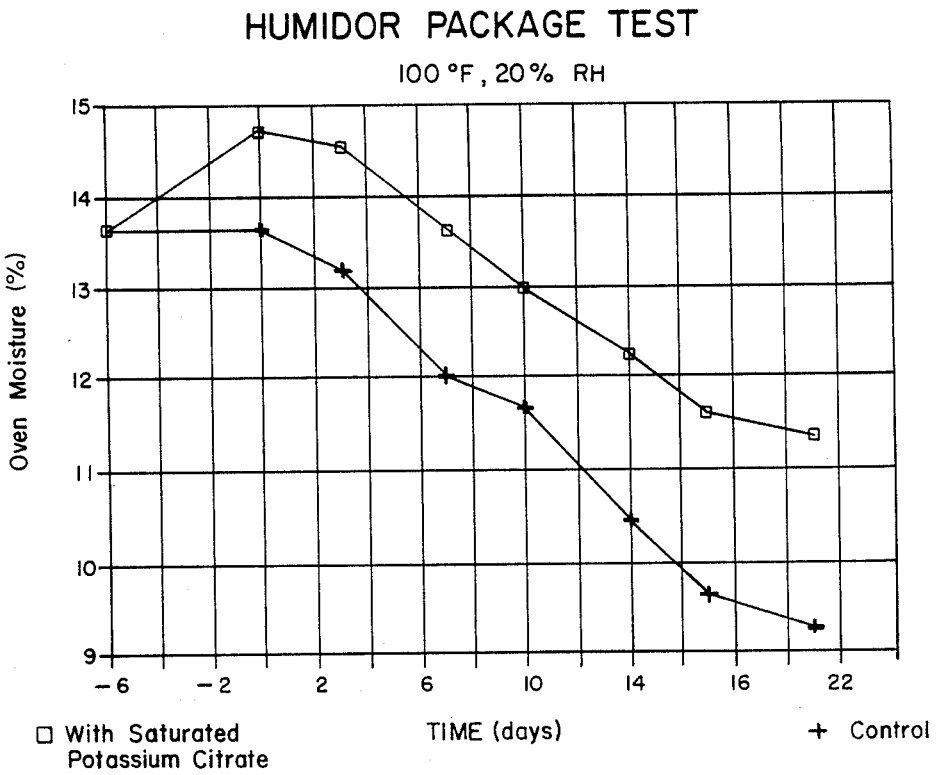
FIG. 6 is a graph representing the results of a later test of another moisture control vehicle treated with a saturated salt solution of potassium citrate $[K_3(C_6H_5O_7)]$compared with an untreated vehicle, disclosing the improved moisture control results over an extended time period.

The results are shown in FIG. 5. The squares represent the test packages and the triangles represent the controls. The lines were calculated before the test began and the data points were added as they were received.

All data points but one fit the calculated curves reasonably well. Currently, there is no reasonable explanation for the "test" data point at 14 days. There is no reason to believe that there would be two plateaus in the NaBr solution moisture loss curve such as the data shown. There is also no reason to believe that the analysis was in error or that only these three packages had bad seals.

The shelf life (time to drop below 12% moisture) for the control package was about 7 days. The shelf life for the humidor package was 12–14.5 days.

The reason that the plateau for the humidor package is at 12.5% moisture rather than 13.5% is that at 100° F. the water activity is 0.54 compared to 0.58 at room temperature. Had the temperature been lowered, such as in an air-conditioned retail store, the cigarette moisture should increase.

A further aging test was noted. In this test, 0.7 cc of saturated potassium citrate and 0.15 cc of water were added to an absorbent pad from Kimberly-Clark (DD-53-LE) made in accordance with U.S. Pat. No. 4,100,324. The pad was used to replace the cardboard spacer in packages of cigarettes. The cigarettes in the control package dropped to 12% moisture in 7 days. The cigarettes in the humidor package dropped to 12% moisture in 15 days.

The test was conducted using production cigarettes. Absorbent pads from Kimberly-Clark (DD-53-LE) were wet with 0.15 ml water followed by 0.7 ml saturated potassium citrate solution. These were used to replace the corrugated spacer inside the packages. The water was added for two reasons: (1) prewetting the pads with water causes the saturated solution to be absorbed faster, (2) to bring the tobacco and packaging into equilibrium with a relative humidity of 62.5% (the equilibrium relative humidity over saturated potassium citrate solution).

After inserting the pads by hand, test and control packages were placed in plastic bags. The next day they were machine overwrapped. Six days later the packages were placed in cartons and the cartons were put into a walk-in desert cabinet at 100° F., 20% RH. The six-day delay was to allow the moisture to equilibrate throughout the package.

The results of the test are shown in FIG. 5. The control packaged cigarettes dropped to 12% moisture in 7 days. The cigarettes in the humidor package dropped to 12% moisture in 15 days. The humidor package thus increased shelf life 2.1 times that of the control package.

Still another accelerated aging test was conducted using 0.7 cc of saturated potassium citrate and 0.15 cc of water on an absorbent pad from Kimberly-Clark (DD-53-UE). The cigarettes in the control package dropped to 12% moisture in 5 days. The cigarettes in the humidor package dropped to 12% moisture in 14 days.

In these three tests, had the same amount of water been added without the dissolved saturating salts, the cigarette moisture would have been about 17%, 20%, and 19% respectively. At these high moisture levels, microbial growth in the cigarettes could occur. In all of the tests described, the cigarette moisture in the humidor packages was below 14.8%.

The invention claimed is:

1. A package structure for storing moisture laden articles comprising:

a shaped receptacle preselectively sized and shaped to receive said moisture laden articles for storing the same with a space between the moisture laden articles and a side wall of the receptacle;

an overwrap layer having a low moisture rate (MVTR) disposed externally of said shaped receptacle and enclosing the shaped receptacle;

a moisture control vehicle structurally separate from the receptacle vertically disposed within and filling the space between said shaped receptacle side wall of said package and the moisture laden articles in the receptacle, said moisture control vehicle being in the form of an absorbent pad impregnated with a saturated salt solution consisting of potassium citrate having a water activity level preselected in accordance with the water activity level of the moisture laden articles to be stored in said shaped receptacle to maintain a controlled moisture equilibrium in the moisture laden articles over an extended period of time, and having a film adjacent one face thereof, said pad being folded upon itself at opposite edges away from said film to leave a gap between facing edges of said pad with the film preventing the sides and one face of the folded vehicle from abutting the receptacle.

2. The package structure of claim 1, and an inside wrapper surrounding said moisture-laden articles when packaged within said shaped receptacle.

3. The package structure of claim 1, said shaped receptacle being of cartonboard material.

4. The package structure of claim 1, said moisture-laden articles being tobacco materials.

5. The package structure of claim 1, said moisture-laden articles being cigarettes.

6. The package structure of claim 1, said moisture control vehicle being impregnated with a saturated salt solution of a type having a water activity of a preselected level below the inherent microbial growth level of the moisture-laden articles to be stored within.

7. The package structure of claim 1, said moisture control vehicle comprising a solution-impregnable membrane which allows water vapor from the saturated solution to pass therethrough while retaining liquid therein.

8. The package structure of claim 1, said moisture control vehicle being in the form of an absorbent pad impregnated with said saturated salt solution.

9. The package structure of claim 1, said moisture control vehicle wherein said saturated salt solution is in the form of a paste.

10. The package structure of claim 1, said moisture control vehicle wherein said saturated salt solution is in the form of a gel.

11. The package structure of claim 1, said moisture control vehicle wherein said saturated salt solution is in the form of a powder.

12. The package structure of claim 1, said moisture control vehicle including a blotter paper impregnated with said saturated

13. The package structure of claim 1, said moisture control vehicle including filter rod structure impregnated with said saturated salt solution.

14. The package structure of claim 1, said moisture control vehicle including corrugated paper material treated with said saturated salt.

15. The package structure of claim 1, said moisture control vehicle including a pouch with a high moisture vapor transmission rate to allow water vapor to pass through readily and to retain liquid, said pouch containing a preselected form of saturated salt solution.

16. The package structure of claim 1, said moisture control vehicle including a pouch of cellulose acetate film with a high moisture vapor transmission rate to allow water vapor to pass through readily and to retain liquid, said pouch containing a preselected form of saturated salt solution.

17. The package structure of claim 1, said moisture control vehicle including dialysis tubing with a high moisture vapor transmission rate to allow water vapor to pass through readily and to retain liquid, said tubing containing a preselected form of saturated salt solution.

18. The package structure of claim 1, said moisture control vehicle including a saturated salt solution having a water activity in the range of approximately 0.52 to 0.66.

19. The package structure of claim 1, said moisture control vehicle including a saturated salt solution of potassium citrate with a water activity of approximately 0.6 to 0.66 at a temperature range of approximately 20° C. to '° C.

20. The package structure of claim 1, said overwrap layer being a polypropylene film.

21. The package structure of claim 1, said overwrap layer being cellophane.

22. The package structure of claim 1, said overwrap layer being a polyethylene.

23. The package structure of claim 1, said overwrap layer being polyvinylidene chloride.

24. The package structure of claim 1, and an inner wrapper of an aluminum foil paper laminate.

25. The package structure of claim 1, said shaped receptacle being of a preselected weight, stiff foldable paper cartonboard.

26. The package structure of claim 1, said shaped receptacle being of a preselected weight, formable and foldable paper material.

27. A cigarette package structure for storing a preselected number of moisture-laden cigarettes comprising:

a polypropylene overwrap layer having a very low moisture vapor transmission rate;

a shaped receptacle disposed within said polypropylene overwrap layer, said receptacle being sized and shaped to receive said preselected number of cigarettes for packaging the same;

an aluminum foil laminate inner wrapper surrounding said packaged cigarettes when disposed within said receptacle; and a moisture control vehicle in the form of an absorbent pad having a film adjacent one face thereof, said pad being folded upon itself at opposite edges away from said film with the film preventing the sides and one face of the folded vehicle from abutting the inner face of said receptacle, said moisture control vehicle for said cigarettes being impregnated with a saturated salt solution of potassium citrate with a water activity of approximately 0.62 at a temperature of approximately 20° C.

* * * * *

UNITED STATES PATENT AND TRADEMARK OFFICE

CERTIFICATE OF CORRECTION

PATENT NO. : 4,934,524

DATED : June 19, 1990

INVENTOR(S) : Frank K. St. Charles

It is certified that error appears in the above—identified patent and that said Letters Patent is hereby corrected as shown below:

Column 1, line 6, before "present invention" insert ---The---,

Column 3, line 4, after "thereof;" delete ---1---,

Column 5, line 14, after "in accordance" delete ---0---,

Column 9, line 63, Claim 12, after "saturated" insert ---salt solution---,

Column 10, line 3, Claim 14, after "saturated salt" insert ---solution---

Column 10, line 28, Claim 19, after "C. to" delete ---'--- and insert ---40---.

Signed and Sealed this

Fifteenth Day of October, 1991

*Attest:*

HARRY F. MANBECK, JR.

*Attesting Officer*

*Commissioner of Patents and Trademarks*